United States Patent [19]

Trulaske

[11] Patent Number: 4,875,745

[45] Date of Patent: Oct. 24, 1989

[54] LATCH FOR COOLER

[75] Inventor: Arthur W. Trulaske, Chesterfield, Mo.

[73] Assignee: True Manufacturing Co., Inc., O'Fallon, Mo.

[21] Appl. No.: 159,383

[22] Filed: Feb. 23, 1988

[51] Int. Cl.[4] ..... A47B 95/00

[52] U.S. Cl. ..... 312/298; 312/109; 312/296

[58] Field of Search ..... 312/107, 109, 296, 298

[56] References Cited

U.S. PATENT DOCUMENTS

| | | | |
|---|---|---|---|
| 754,814 | 3/1904 | Schriefer | 312/109 |
| 892,187 | 6/1908 | Schriefer | 312/107 |
| 909,951 | 1/1909 | Schriefer | 312/107 |
| 1,165,013 | 12/1915 | Martineau | 292/57 |
| 1,511,725 | 10/1924 | Hart | 312/217 |
| 1,792,540 | 2/1931 | Johnson | 292/57 |
| 2,438,783 | 3/1948 | Kraft | 312/217 |
| 2,749,851 | 6/1956 | Dorey | 292/57 |
| 2,960,374 | 11/1960 | Kozelka | 312/218 |
| 3,623,269 | 11/1971 | Algrain | 49/449 |
| 4,285,559 | 8/1981 | Koch | 312/298 |

*Primary Examiner*—Joseph Falk

*Attorney, Agent, or Firm*—Cohn, Powell & Hind

[57] ABSTRACT

Conversion apparatus (1) for a multiple door cooler (C). A seal (3) for forming a seal between a door and the cooler housing (H), when the door is closed, has a base element (5) which is affixed to the inner face (1F) of the door and extends around its periphery. A latch (27) attaches to the base element of one door and the base element of an adjoining door to form a rigid connection between the doors so they open and close in unison.

8 Claims, 1 Drawing Sheet

LATCH FOR COOLER

BACKGROUND OF THE INVENTION

This invention relates generally to multiple door coolers such as commercial refrigerators, and more particularly, to a latch apparatus for converting multiple door operation of the cooler to single door operation.

Supermarkets, and other comparable businesses use large commercial refrigerators to store and keep cool various perishable food stuffs. Their refrigerators are typically multiple door units. For example, a common refrigerator has four separately operable doors arranged in two banks of two. To prevent pilferage each door is equipped with a separate lock. Locking and unlocking each lock, constantly opening and closing each door, can be a time consuming and expensive process especially when similar food stuffs are stored in adjacent regrigeration chambers.

This invention solves this problem in a manner not disclosed in the known prior art.

SUMMARY OF THE INVENTION

This invention provides a means of converting multiple door refrigerator operation to single door operation.

More particularly, it is an aspect of the invention to convert two or more vertically arranged doors in a refrigeration unit to single door operation.

It is a further aspect of the invention to make such a conversion with a minimum of modification to a refrigerator.

It is further an aspect of the invention to provide for quick and easy conversion from a multiple to single door operation and for reconversion back to multiple door operation.

It is an aspect of this invention to provide a conversion apparatus for a multiple door cooler of the type having vertically adjacent doors which are separate and closable and are mounted on a cooler housing, the apparatus comprising sealing means attached to the inner face of each door and extending around the periphery to form a seal between the door and the housing when the door is closed; and latch means attachable to the sealing means of adjacent doors to form a rigid connection therebetween whereby the doors are converted into a single door and open and close in unison.

It is another aspect of this invention to provide that the sealing means includes a multiple channel base element affixed to the inner face of each door.

It is yet another aspect of this invention to provide a rod formed to fit in one of the channels of the base element of one door and selectively extend in connected relation to the other door.

Still another aspect of this invention is to provide that the latch means includes a guide received in the appropriate channel of each door base element and receiving the latch rod.

Another aspect of this invention is to provide openings in the channel sides of the base elements perpendicular to the rod so that the rod can be inserted through the guide and openings of one base element, and through the openings and guide of the second base element.

Yet another aspect of this invention is to provide that the one base element channel receiving the guide has opposed sides, the rod having an L-shaped portion and one of said sides having a notch to receive the L-shaped portion to lock the rod in place.

In another aspect of this invention the base element channels receiving the guides include inwardly projecting tabs and the guide include opposed grooves receiving said tabs to hold said guides in place.

Still another aspect of this invention is to provide one vertically adjacent door with a lock which cooperates with the latch means to lock the vertically adjacent doors.

Other aspects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3, 4, 5:
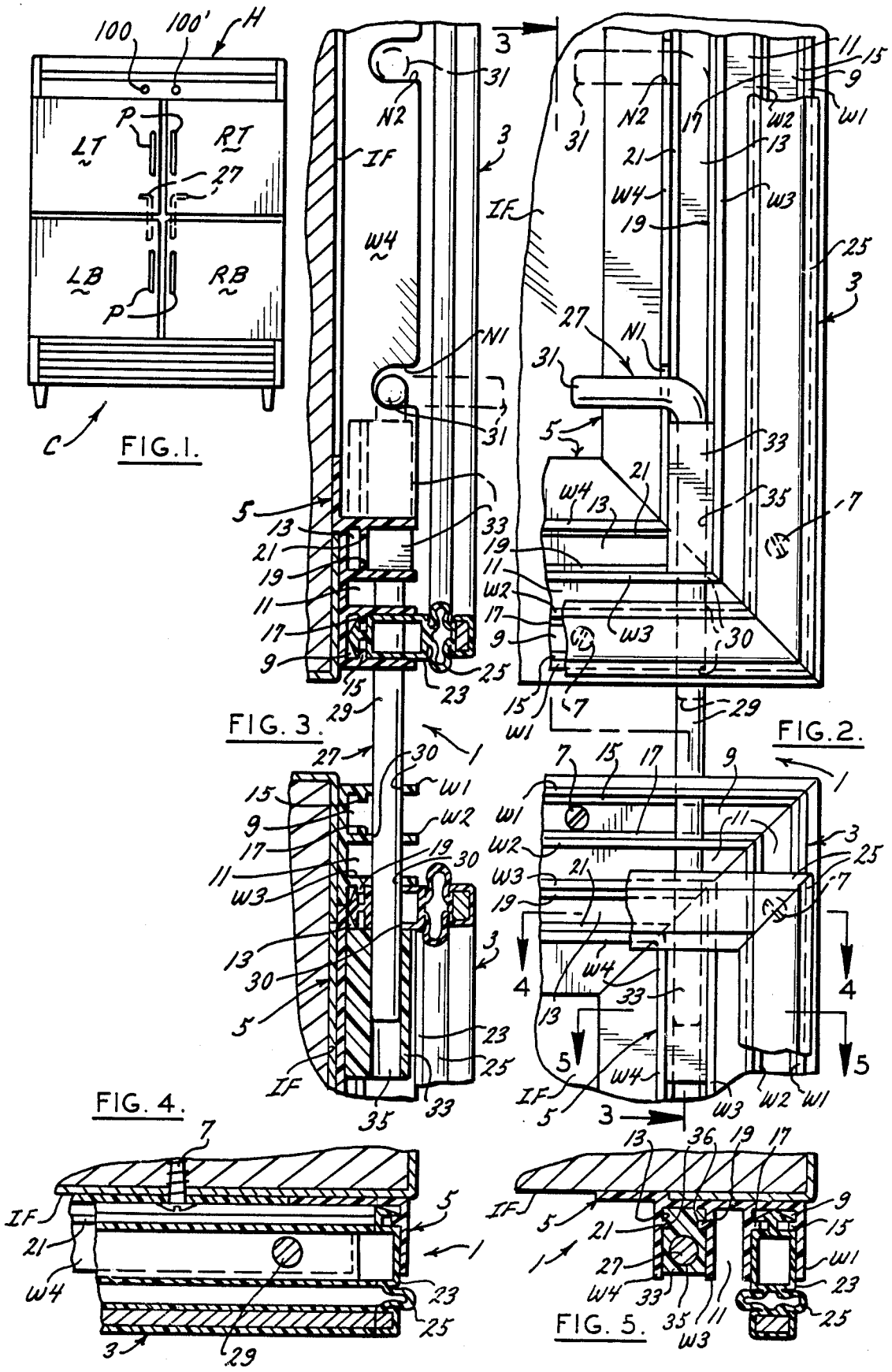
FIG. 1 is a front elevational view of a multiple door cooler with which the present invention is used.
FIG. 2 is a partial elevational view of the inner face of vertically adjacent doors with the apparatus of the present invention in place.
FIG. 3 is a sectional view taken along line 3—3 of FIG. 2.
FIG. 4 is a sectional view taken along line 4—4 in FIG. 2.
FIG. 5 is a sectional view taken along line 5—5 in FIG. 2.

Referring now be reference numerals to the drawings it will be understood that, a cooler C, which may be, for example, a refrigerator or a freezer has a housing H. The cooler has four doors Lt, LB, RT, and RB mounted to the housing, these doors being vertically arranged in a left side bank (LT and LB) and a right side bank (RT and RB). Each door is separately openable and closable and each upper door may either come with a lock 100, or a padlock (not shown) may be fitted through the appropriate pull handles P of the top doors (LT and RT) or bottom doors (LB and RB) to secure the contents stored in the cooler.

While having multiple doors on cooler C may be a convenience in many instances, there are times when the need to keep opening and closing the various doors can be both time consuming and bothersome. This is especially so when, for example, identical or similar items are stored behind separate doors but yet need to be removed and stored simultaneously.

The present invention comprises a conversion latching apparatus indicated by 1 for converting multiple doors such as the vertical doors LT and LB or RT and RB into a single door. Apparatus 1 includes a conventional sealing means 3 affixed to the inner face IF of each door. Sealing means 3 includes a base element 5 secured to the inner face of each door by a screws 7 or the like and extending around the periphery of the door. The base element is a multiple channel extruded plastic which is fitted to the inner face of a door in vertical and horizontal sections, the ends of the respective sections being mitered to provide a correct fit. As shown in the drawings, the base element is formed with four outwardly projecting walls W1-W4 which form three channels 9, 11 and 13. Tabs 15 and 17, and 19 and 21 extend inwardly into channels 9 and 13 respectively from the sidewalls.

A sealing element 23 such as is well known in the art, fits into outer channel 9 of each section of base element 5. The outer portion of the sealing element is a flexible seal 25 which is compressed against housing H, when a door is closed, to provide an air tight seal.

Importantly, apparatus 1 includes a latch means 27 comprising an L-shaped rod 29. Rod 29 is sufficiently long so as to extend from one door to the adjacent door (see FIG. 1). To rigidly secure two adjacent doors, the lower horizontal base element in one of the upper doors (LT or RT) and the upper horizontal base element in the corresponding lower door (LB or RB) have a series of openings or holes 30 cut in the horizontal side walls W1, W2 and W3. These openings are in registry and perpendicular to the rod and, as shown in FIG. 2, allow rod 29 to be inserted through the base elements in two vertically adjacent doors to rigidly connect the doors. One or more notches N1 and N2 are formed in vertical side wall W4 of the vertically extending base element of the upper door so the short arm 31 of rod 29 can be locked in place. This feature provides the advantage that the latch rod 29 cannot readily be raised from outside of the cooler, as by pliers for example, and permits the use of a single lock 100 to lock two vertically adjacent doors. In fact, if desired, a single lock 100' capable of locking horizontally adjacent doors together, can be used to lock all four doors. In addition, tube guides 33 can be fitted in the channel 13 of the vertical base elements of each door. These guides each have longitudinal bores 35 therethrough rigid to receive rod 29, and in the embodiment shown, includes side grooves 36 which are received by tabs 19 and 21 to hold the guides in place in the channels, the guides being fitted prior to the attachment of the base elements to the inner face of the door.

In operation, rod 29 extends between an upper and a lower door through appropriate openings 30 in the base elements. Arm 31 of the rod is nestled in nothce N1 to lock the rod in place and rigidly connect the two adjacent upper and lower doors so they open and close in unison. When it is intended for the doors to be separately openable and closable, the rod is rotated 90° and simply raised until arm 31 of the rod reaches notch N2 and is rotated into said notch. In this position, the rod is completely raised from and free of the lower door but can readily be repositioned whenever it is intended that the adjacent doors be operated as a unit. For a cooler C as shown in FIG. 1, this means the cooler can be used as a four-door unit (its normal configuration), a three-door unit (if apparatus 1 is used only on one of the vertical bank of doors), or a two-door unit (if the apparatus is used with both banks of doors).

It will be understood that the configuration shown in FIG. 1 and described herein is exemplary only and if, for example, three or more doors were vertically arranged, the apparatus would allow all the doors to be operated in unison. Similarly, if the doors were arranged horizontally and hinged to open from the top or bottom, the apparatus would allow them to be operated in unison.

Although the improved latch assembly has been described by making particularized reference to a preferred latch mechanism, the details of description is not to be understood as restrictive, numerous variants being possible within the principles disclosed and within the fair scope of the claims hereunto appended.

I claim as my invention:

1. In a cooler having two or more doors mounted to a housing of the cooler, the doors being vertically arranged and separately openable and closable and each having an inner face, an improvement comprising conversion apparatus for converting the multiple doors to a single door, the conversion apparatus including a sealing means comprising a multiple channel base element affixed to the inner face of each door and extending around the periphery thereof to form a seal between the door and the housing when the door is closed; and, latch means attachable to the sealing means of one door and the sealing means of an adjacent door to form a rigid connection therebetween whereby the doors operate in unison.

2. In a multiple door cooler wherein the doors, which are separately openable and closable and includes an inner face, are mounted on a cooler housing adjacent each other, the improvement comprising conversion apparatus for converting the doors into a single door, the conversion apparatus including:

sealing means affixed to the inner face of each door and extending around the periphery thereof to form a seal between the door and the housing when the door is closed, the sealing means comprising a multiple channel base element affixed to the inner face of each door; and latch means attachable to the sealing means of one door and the sealing means of a vertically adjacent door to form a rigid connection therebetween whereby the doors open and close in unison.

3. The apparatus of claim 2 wherein the latch means includes a rod formed to fit in one of the channels of the base element of one door and selectively extend in connected relation to the other door.

4. The apparatus of claim 3 wherein the latch means further includes a guide received in the appropriate channel of each base element, each guide having a longitudinal bore therethrough sized to receive the rod.

5. The apparatus of claim 4 wherein each base element of each door has channel sides perpendicular to the rod and openings formed in the sides thereof for the rod to be inserted through the guide in one base element, through the openings in the channel sides of said base element, through the openings in the channel sides of the base element of the vertically adjacent door and into the guide in the second said base element.

6. The apparatus of claim 4 wherein one base element channel receiving the guide has opposed sides, the rod having an L-shaped portion and one of said sides having a notch to receive the L-shaped portion of the rod to lock the rod in place.

7. The apparatus of claim 4 wherein the base element channels receiving the guides include inwardly directed tabs and said guides include opposed grooves receiving said tabs to hold said guides in place.

8. The apparatus of claim 2 wherein one vertically adjacent door is provided with a lock which cooperates with the latch means to lock said vertically adjacent doors.

* * * * *